US006129180A

United States Patent [19]

Brady

[11] Patent Number: 6,129,180

[45] Date of Patent: Oct. 10, 2000

[54] SAWHORSE

[76] Inventor: Troy S. Brady, 8454 Hagerty Rd., Ashville, Ohio 43103

[21] Appl. No.: 09/416,630

[22] Filed: Oct. 12, 1999

Related U.S. Application Data

[63] Continuation-in-part of application No. 08/842,093, Apr. 28, 1997, abandoned.

[51] Int. Cl.[7] ..... E04G 1/00

[52] U.S. Cl. ..... 182/186.4; 182/155; 182/181.1; 182/186.3; 182/225

[58] Field of Search ..... 182/129, 153, 182/154, 155, 181.1, 182.1, 185.1, 186.1, 186.3, 186.4, 224, 225

[56] References Cited

U.S. PATENT DOCUMENTS

| | | | |
|---|---|---|---|
| D. 279,606 | 7/1985 | Merians | D25/67 |
| D. 300,861 | 4/1989 | Correll et al. | D25/67 |
| 1,143,397 | 6/1915 | Horn | 182/153 |
| 1,636,342 | 7/1927 | Whelan | 182/153 |
| 2,480,702 | 8/1949 | Bradford | 182/153 X |
| 2,594,464 | 4/1952 | Loucks, Jr. | 182/155 X |
| 3,180,452 | 4/1965 | Gilmour | 182/181 |
| 3,502,174 | 3/1970 | Cannon | 182/155 |
| 3,763,958 | 10/1973 | Hanson | 182/181 |
| 4,014,404 | 3/1977 | Jackson | 182/155 |
| 4,102,434 | 7/1978 | Blank | 182/181 |
| 4,226,301 | 10/1980 | McDaniel et al. | 182/155 |
| 4,298,094 | 11/1981 | Strong | 182/153 X |
| 4,533,091 | 8/1985 | Knight et al. | 182/129 X |
| 4,880,080 | 11/1989 | Brockman | 182/155 |
| 4,884,658 | 12/1989 | Banfield | 182/155 X |
| 4,967,877 | 11/1990 | Wallman et al. | 182/155 |
| 5,078,352 | 1/1992 | Brow | 182/153 X |
| 5,125,478 | 6/1992 | Henningsen | 182/155 |
| 5,404,962 | 4/1995 | Carter | 182/153 |
| 5,560,449 | 10/1996 | Smith | 182/153 |

*Primary Examiner*—Alvin Chin-Shue
*Assistant Examiner*—Richard M. Smith
*Attorney, Agent, or Firm*—John L. Gray, Esq.; Kegler, Brown Hill & Ritter

[57] ABSTRACT

A sawhorse provided with a pair of supports supporting a horizontal member wherein the supports are angled toward the respective ends of the horizontal member and where the ends of the supports are within the space of the ends of the horizontal member and the supports themselves are made of leg portions and portions which support the underside of the horizontal member and are connected therethrough, the latter section being flat and being at an obtuse angle with said legs.

1 Claim, 2 Drawing Sheets

SAWHORSE

This is a continuation-in-part of Ser. No. 08/842,093, filed Apr. 28, 1997, now abandoned.

BACKGROUND OF THE INVENTION

Sawhorses come in many sizes and shapes and designs as is evidenced by the sawhorses which may be folded up for storage shown in Design Pat. No. 279,606, Merians, and U.S. Pat. Nos. 3,502,174, Cannon, and 4,014,404, Jackson. None of these references, however, provide a sawhorse which is so constructed that it will sustain a heavy load at one end of the sawhorse when in use without tipping up. Many of such sawhorses also require considerable labor in their manufacture and have load capacity limits, especially at the ends thereof

BRIEF SUMMARY OF THE INVENTION

Applicant's invention allows the use of angled support braces for the sawhorse, preferably made of a tubular material, except for the portion engaging the horizontal member, which are so placed with respect to the horizontal member that they will support a load at the end of the horizontal member which would otherwise cause the prior art sawhorses to tip up, yet because of their location permit an individual to conduct work on goods positioned at the end of the sawhorse without interference from the support legs. The sawhorse may also be readily folded for storage.

It is therefore an object of this invention to provide a sawhorse that contains supports which may be readily and cheaply manufactured and supports that may be easily and simply attached to the horizontal member of the sawhorse and which when correctly positioned on the horizontal member will result in unusual load bearing capacities at the end of said horizontal member.

This, together with other objects of the invention, will become apparent from the following detailed description of the invention and the accompanying drawings.

DETAILED DESCRIPTION OF THE INVENTION

Figure 1:
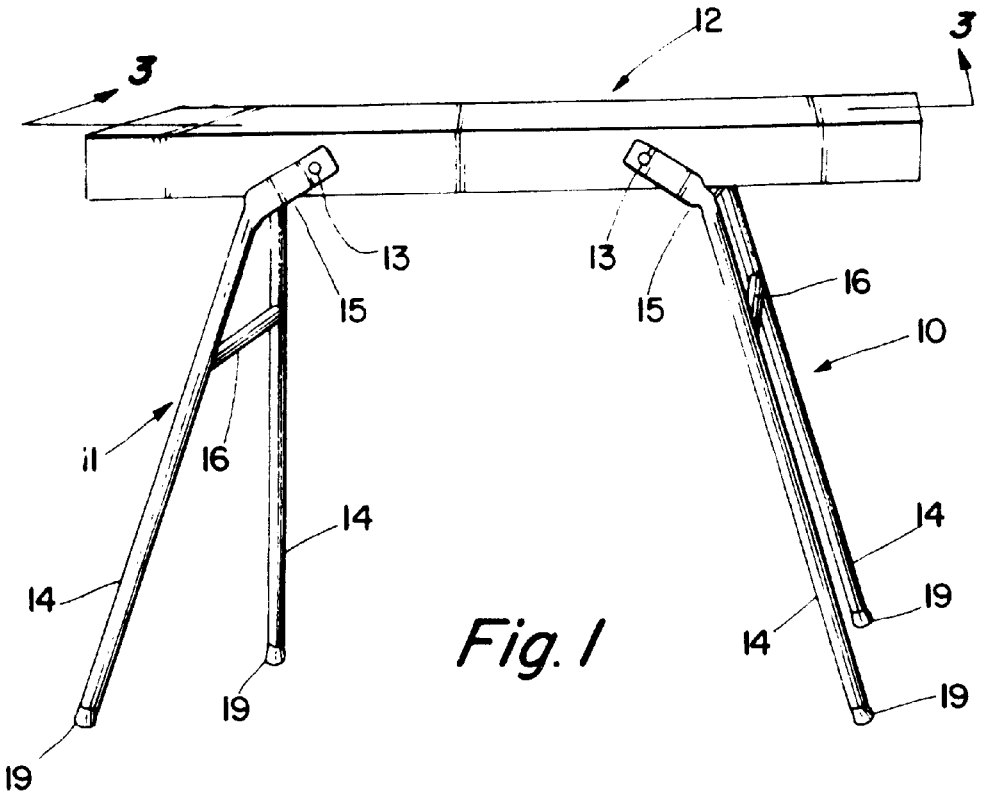
FIG. 1 is a side elevation view of Applicant's sawhorse showing the two oppositely disposed support members and the horizontal member.

Referring now to FIG. 1, Applicant's invention is shown with two support members 10 and 11 each of which are attached to horizontal member 12 by means of bolts 13—13 extending through said horizontal member 12 and engaging the support members 10 and 11 in opening 12*a*–13*a* on the opposite sides thereof. See FIG. 5.

It should be noted that the lower ends 14—14 of said support members 10 and 11 are positioned so that when resting on the ground they are at a vertical position at the end or within the horizontal member 12, thus forming an approximate 70 degree angle with said horizontal member 12. It should also be noted that the portions of the support members 15—15 are formed at an obtuse angle with the leg portions 14—14 of the support members 10 and 11.

The support members 10 and 11 are held in position underneath the horizontal member 12 by connections 17—17 which are better shown in subsequent figures. The support members 10 and 11 are provided with further connections 16—16 separating the leg members 14—14.

Figure 2:
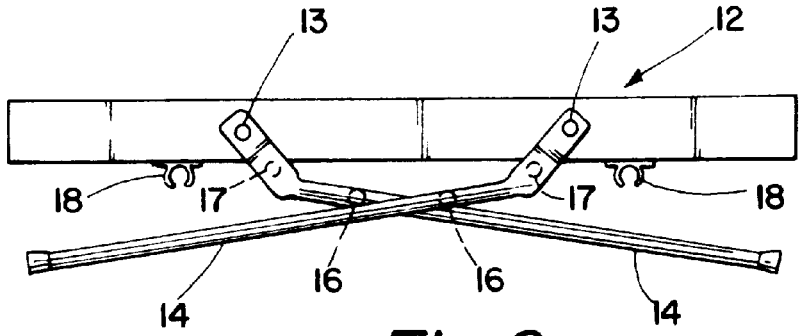
FIG. 2 is a side elevation view of Applicant's sawhorse with the supporting members folded for storage purposes.

Referring now to FIG. 2, support members are shown folded, and it will be noted that the connections 17—17 which prevent further upward movement of the support members when engaging the lower side of horizontal member 12 are shown in position engaging the lower side of horizontal member 12. Also shown in FIG. 2 are spring clips 18—18 which are adapted to engage connection 17—17 when the support members 10 and 11 are in the position shown in FIG. 1. These clips will hold the support members 10 and 11 in the position relative to the horizontal member 12 when horizontal member 12 is lifted, yet the support members 10 and 11 may be readily removed from these clips for positioning as shown in FIGS. 2 and 4.

Figure 3:
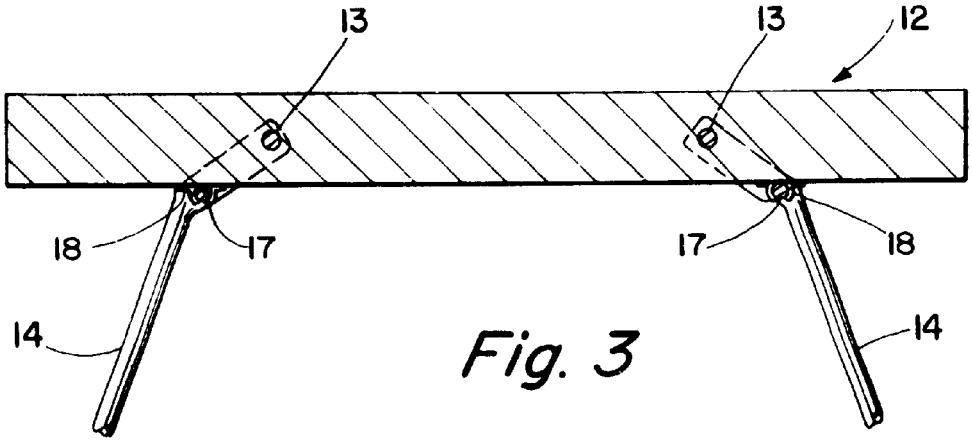
FIG. 3 is a sectional view of Applicant's sawhorse in the plane of 3—3 of FIG. 1.

This portion of the invention is also shown in FIG. 3 where connections 17—17 of support members 10 and 11 are shown adjacent the underside of horizontal member 12.

Figure 4:
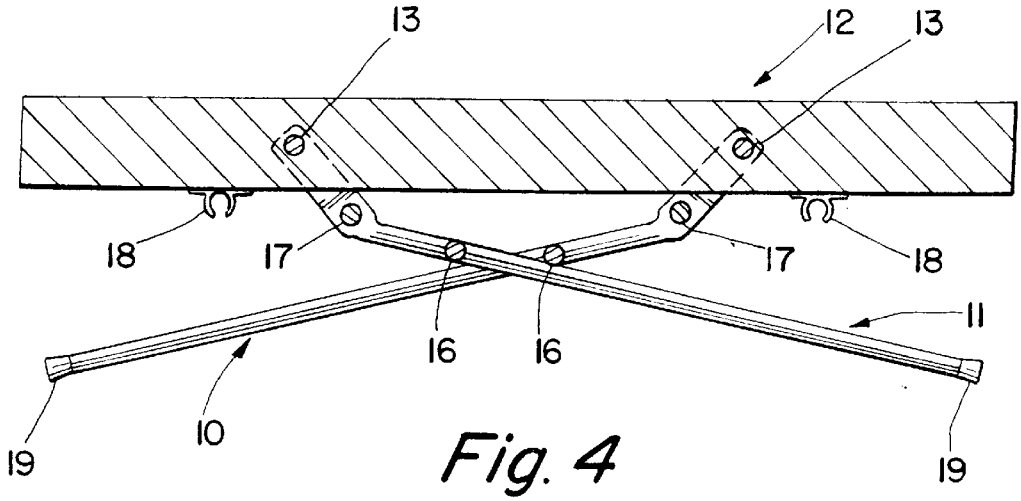
FIG. 4 is a sectional view of Applicant's sawhorse in the plane of 3—3 of FIG. 1 with the supports in a folded position as in FIG. 2.

FIG. 4 is the same as FIG. 2, but is shown in section along the plane 3—3 of FIG. 1.

Figure 5:
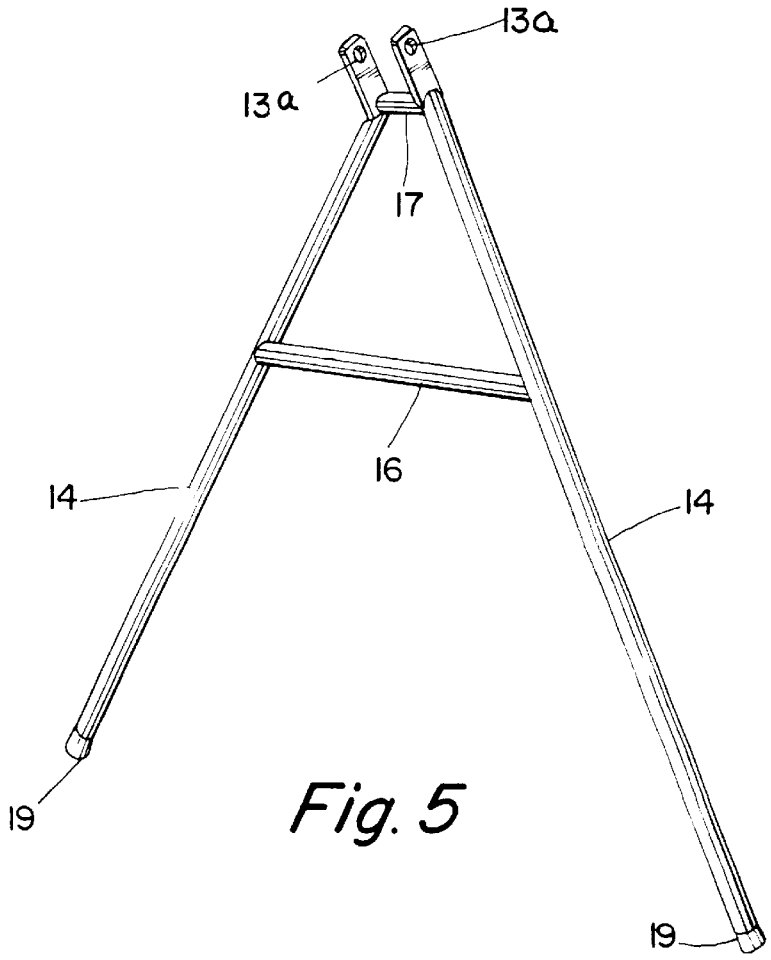
FIG. 5 is a perspective view of one of the support members of Applicant's sawhorse.

FIG. 5 is a perspective view of one of the support members 10 and 11 clearly showing the connection 17 which engages the underside of the horizontal member 12. FIG. 5 also shows the oblique angle between the upper portion of the support members 10 and 11 and the legs 14—14.

The sawhorse supports of the present invention are preferably made from tubular metal rods with the connections 16 and 17 being welded to the legs 14—14. If desired, the portions of the legs of the supports which abut the horizontal member 12 may be readily flattened, as shown, but is preferred to maintain the portions of the support members 15—15 in tubular shape which enables the resultant structure to be stronger and cheaper to produce.

The legs 14—14 of the supports 10 and 11 may be provided with rubber plastic tips 19—19.

While this invention has been shown and described with respect to a detailed embodiment thereof, it will be understood by those skilled in the art that various changes in form and detail thereof may be made without departing from the scope of the claims of the invention.

What is claimed is:

1. A sawhorse comprising;

a horizontal member having a first end and a second end, and two sides extending there between, said horizontal member being supported by a pair of supports, each of said supports comprising a pair of legs having first and second ends, said legs of each of said supports being connected together at the first end of each of said legs through said sides of said horizontal member a distance spaced from one of the ends of said horizontal member sufficient to permit the second ends of said legs to be positioned vertically under or inside the ends of said horizontal member, said legs of each of said supports being spaced further apart at the second ends than at the first ends, said legs of each of said supports also being connected together by a member which is round in cross-section and at a point on said legs underneath and immediately adjacent to said horizontal member, and the portion of each of said legs of each of said supports extending from said first end of each of said legs to the point where said legs are connected together underneath and immediately adjacent to said horizontal member being at an obtuse angle to the remainder of said leg, and two clips directly holding said member which is round in cross-section for releasably holding each of said supports adjacent said horizontal member, when said horizontal member is being supported by said supports, one of said clips being attached to said horizontal member between said first end of said horizontal member and the location on said horizontal member where the first ends of each of said legs of one of said supports are connected through said horizontal member, the other of said clips being attached to said horizontal member between said second end of said horizontal member and the location on said horizontal member where the first ends of each of said legs of the other of said supports are connected through said horizontal member.

* * * * *